US009120342B2

(12) United States Patent
De Grijs et al.

(10) Patent No.: US 9,120,342 B2
(45) Date of Patent: Sep. 1, 2015

(54) METHOD FOR FULL BLEED PRINTING

(71) Applicant: OCE-TECHNOLOGIES B.V., Venlo (NL)

(72) Inventors: Eduard T. H. De Grijs, Venlo (NL); Ronnie E. A. Blom, Linne (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/468,859

(22) Filed: Aug. 26, 2014

(65) Prior Publication Data

US 2014/0362134 A1 Dec. 11, 2014

Related U.S. Application Data

(63) Continuation of application No. PCT/EP2013/053447, filed on Feb. 21, 2013.

(30) Foreign Application Priority Data

Mar. 9, 2012 (EP) ..... 12158741

(51) Int. Cl.
*B41J 29/393* (2006.01)
*B41J 25/00* (2006.01)
*B41J 11/00* (2006.01)

(52) U.S. Cl.
CPC ..... *B41J 25/001* (2013.01); *B41J 11/0065* (2013.01); *B41J 11/0095* (2013.01)

(58) Field of Classification Search
CPC .. B41J 2/04541; B41J 2/0458; B41J 2/04581; B41J 11/0065
USPC ..... 347/16, 19
See application file for complete search history.

(56) References Cited

U.S. PATENT DOCUMENTS

| | | | | |
|---|---|---|---|---|
| 6,039,481 | A | 3/2000 | Ham | |
| 6,469,806 | B1 | 10/2002 | Richenderfer et al. | |
| 6,547,462 | B1 | 4/2003 | Yanagi et al. | |
| 7,095,526 | B1 * | 8/2006 | Housel | 358/1.18 |
| 2002/0181986 | A1 * | 12/2002 | Castano et al. | 400/74 |
| 2004/0141782 | A1 | 7/2004 | Kato | |
| 2005/0001867 | A1 * | 1/2005 | Akase | 347/16 |
| 2005/0093901 | A1 * | 5/2005 | Yraceburu et al. | 347/9 |
| 2006/0069988 | A1 * | 3/2006 | Bailey | 715/521 |
| 2014/0146102 | A1 * | 5/2014 | Mizes et al. | 347/14 |

FOREIGN PATENT DOCUMENTS

EP 1 388 422 A2 2/2004

* cited by examiner

*Primary Examiner* — Julian Huffman
*Assistant Examiner* — Sharon A Polk
(74) *Attorney, Agent, or Firm* — Birch, Stewart, Kolasch & Birch, LLP

(57) ABSTRACT

The invention relates to a method for full bleed printing using an inkjet printing apparatus. In the method for full bleed printing, a reference pattern is applied on the receiving medium in a current swath. The carriage of the inkjet printing apparatus and the receiving medium are moved with respect to one another in the sub scanning direction and in a subsequent swath, the distance between the reference pattern and a side edge of the receiving medium is determined, and based on the determined distance between the reference pattern and the side edge of the receiving medium, dots to be printed in an area between the side edge of the receiving medium and the reference pattern are determined.

20 Claims, 6 Drawing Sheets

METHOD FOR FULL BLEED PRINTING

CROSS REFERENCE TO RELATED APPLICATIONS

This application is a Continuation of PCT International Application No. PCT/EP2013/053447, filed on Feb. 21, 2013, which claims priority under 35 U.S.C. 119(a) to patent application Ser. No. 12/158,741.4, filed in Europe on Mar. 9, 2012, all of which are hereby expressly incorporated by reference into the present application.

The present invention relates to a method for full bleed printing.

BACKGROUND OF THE INVENTION

In inkjet printing, an image is build up drop wise by jetting droplets of ink onto a receiving medium, using a print head. The image may cover the whole surface of the receiving medium. This is known as full bleed printing. In full bleed printing, an image is printed onto a receiving medium such that the image extends to the edges of a receiving medium. The image may extend to all edges of a receiving medium, or, for example in roll-to-roll printing, the image may extend to at least the side edges of the receiving medium. The area of the receiving medium not covered by droplets of ink should be as small as possible, resulting in white edges surrounding the image on the receiving medium being as small as possible.

In order to print full bleed, the droplets of the ink have to be positioned as close to the edge of the receiving medium as possible, in order not to leave white areas around the image. On the other hand, it is undesired to position droplets of ink outside the edges of the receiving medium, as, in that case, the ink applied outside the edges of the medium pollutes the printing apparatus. For example, the transport belt for transporting the receiving medium may be polluted, thereby polluting the backside of the receiving medium or polluting later receiving media. Thus, in order to print full bleed, it is preferred to print as close to the edges of the receiving medium as possible, however, without printing outside the side edges of the receiving medium.

Methods for full bleed printing are known, wherein the position of (side) edges of the receiving medium are monitored during printing, e.g. by scanning the receiving medium when printing. However, such a method may be inaccurate, e.g. because the scanner may be positioned inaccurately with respect to the print heads. For example due to differences in thermal expansion, the position of the scanner with respect to the print heads may vary, leading to inaccuracies in calibrating the position of the print heads with respect to the receiving medium during printing.

It is therefore an object of the present invention to provide a method for full bleed printing with improved accuracy. It is a further object of the present invention to provide an inkjet printing apparatus configured to carry out such method.

SUMMARY OF THE INVENTION

The object of the invention is achieved in a method for full bleed printing using an inkjet printing apparatus, the inkjet printing apparatus comprising a carriage, the carriage comprising a print head, the method comprising:

a) in a current swath, moving the carriage and a receiving medium relative to each other in a main scanning direction and printing a reference pattern on the receiving medium;

b) moving the carriage and the receiving medium relative to each other in a sub-scanning direction;

c) in a subsequent swath, determining a distance between the reference pattern and a side edge of the receiving medium;

d) based on the determined distance between the reference pattern and the side edge of the receiving medium, determining dots to be printed in an area between the side edge of the receiving medium and the reference pattern.

In inkjet printing, an image may be build up drop wise by applying droplets of ink onto a receiving medium using an inkjet printing apparatus. The droplets of ink may be ejected by a print head. The print head may be mounted on a carriage. In scanning inkjet, the print head ejecting the droplets and the receiving medium move relative to each other in a main scanning direction. This may be done by moving a print head, mounted on a carriage over the receiving medium in the main scanning direction when applying droplets of ink to the receiving medium.

In a current swath, the carriage carrying the print head and the receiving medium may move relative to one another and a reference pattern may be printed onto the receiving medium. The reference pattern may be any suitable pattern, build up of droplets of ink applied onto the receiving medium by a print head.

After the current swath has been completed, the carriage and the receiving medium may be moved relative to each other in a sub scanning direction. The relative movement of the carriage and the receiving medium with respect to each other in between swaths is known as paper step. For example, the paper step may be performed by moving the receiving medium in a sub scanning direction. The receiving medium may be moved such that a part of the receiving medium not yet provided with the image is positioned such that the print head may jet droplets of ink onto that part of the receiving medium when the carriage moves in the main scanning direction. Preferably, the movement in the sub scanning direction is such that the paper step is not visible in the printed image. After the paper step has been performed, the carriage and the receiving medium may move again with respect to one another in the main scanning direction in a subsequent swath. In the subsequent swath, the part of the receiving medium positioned in the area to be provided with an image by the print head mounted on the carriage during the subsequent swath, may comprise the reference pattern. In the subsequent swath, the distance between the reference pattern and a side edge of the receiving medium is determined. By determining the distance between the reference pattern and a side edge of the receiving medium, the position of the print head with respect to the receiving medium may be determined directly by detecting the reference pattern and the side edge of the paper, i.e.: the position of the print head determined by determining the distance between the side edge of the receiving medium and the reference pattern is independent of the position of the print head with respect to the inkjet printing apparatus. For example, the position of the print head with respect to the receiving medium may be determined independent of the position of the print head with respect to the position of detection means used to detect the side edge of the receiving medium. In the current swath, the reference pattern has been applied on the receiving medium by the print head mounted on the carriage. When a distance between the side edge of the receiving medium and the reference pattern is determined directly, the position of the print head with respect to the (side edge of the) receiving medium may be determined. This may provide improved accuracy compared to a method, wherein only the position of a side edge of the receiving medium is detected; i.e. compared to a method wherein the position of the print head with respect to the side edge is determined indirectly. In the latter case, e.g. in a case wherein the position of the side edge of the receiving medium is detected by a detecting means, e.g. a scanner, mounted on the carriage, the calibration may suffer from inaccuracies in the positioning of the detection means with respect to the print head. When the print head and the detection means are mounted on the same carriage, the distance between the detection means and the print head may vary, for example because of thermal expansion.

When the distance between reference pattern and the side edge of the receiving medium is determined, dots to be printed in an area between the side edge of the receiving medium and the reference pattern may be determined. The number of dots may be related to a certain distance. For example, a specified numbers of dots may be applied onto the receiving medium per length-unit. For example, the image may be applied to the receiving medium in 300 dots per inch (300 dpi), or 600 dpi. In case the distance is known, the number of dots to be applied onto the receiving medium in between the reference pattern and the side edge of the receiving medium may be determined. Thereby, the area of the receiving medium in between two side edges may be covered with the image, formed by the droplets of ink applied onto the receiving medium, without applying ink onto an area outside the area of the receiving medium in between two side edges. Thus, an image may be formed onto a receiving medium without leaving unprinted margins around the image and without contaminating the printing apparatus by ink spilled.

In an embodiment, the method further comprises:

i. in a first swath, moving the carriage and the receiving medium relative to each other in a main scanning direction;

ii. detecting a position of a side edge of the receiving medium;

iii. determining, based on the position of the side edge of the receiving medium, the position of the reference pattern to be printed;

wherein steps i-iii are carried out before step a.

When the reference pattern is applied onto the receiving medium and the reference pattern is used to determine dots to be printed in an area between the side edge of the receiving medium and the reference pattern, it may be advantageous to apply the reference pattern at a position relatively close to the side edge of the receiving medium. The position of the side edge of the receiving medium may not be known before starting printing. For example, it may be unknown which size of paper is fed to the printing apparatus. Moreover, the receiving medium fed to the printing apparatus may be in a skewed position, as a result of which the position of a side edge of the receiving medium may change as the receiving medium is moved in the sub scanning direction. In addition, a side edge of the receiving medium may be irregular.

In the embodiment, before the reference pattern is applied in step a), the carriage and the receiving medium are moved relative to each other in a main scanning direction, in a first swath. The carriage may be moved, the receiving medium may be moved or both the receiving medium and the carriage may be moved in the main scanning direction. In the first swath, the position of a side edge of the receiving medium is detected. The position of one side edge may be detected or the position of more than one side edge may be detected.

After the position of a side edge of the receiving medium has been detected, the position of the reference pattern to be printed may be determined based on the position of the side edge of the receiving medium. For example, the reference pattern may be applied on the receiving medium at a predetermined distance from the side edge of the medium. For example, the reference pattern may be applied at 1 cm distance, or at 1 mm distance from the side edge. The predetermined distance between the reference pattern and the side edge should preferably not be too large, because a longer distance may result in decreased accuracy of the measurement. The predetermined distance between the reference pattern and the side edge should preferably not be too small, either. When the distance between the reference pattern and the side edge is too small, the reference pattern may locally be positioned on the side edge of the receiving medium. For example, the receiving medium may be fed to the printing apparatus in a skewed position. The side edge of the receiving medium may not be straight, but may have an irregular shape. When the reference pattern is applied to the receiving medium in a position wherein at least a part of the reference pattern coincides with the side edge of the receiving medium, the distance between the reference pattern and the side edge of the receiving medium may, at least locally, not be determined anymore.

In addition, the distance from the side edge at which the reference pattern is applied, may be adapted to the resolution of a detection means used to determine said distance. Detection means may preferably have a resolution such that the distance between the side edge of the receiving medium and the reference pattern may be suitably determined.

In an embodiment, in step c), the distance between the reference pattern and a side edge of the receiving medium is determined based on a detected position of the reference pattern and on a detected position of the side edge of the receiving medium and wherein detection of the position of the reference pattern and detection of the position of the side edge of the receiving medium is performed by detection means mounted on the carriage, and wherein the distance between the detection means and each print head is larger than the distance between the reference pattern and the side edge of the receiving medium.

The determination of the distance between the reference pattern and a side edge of the receiving medium may be based on a detected position of the reference pattern applied on the receiving medium and a detected position of the side edge of the receiving medium. The distance between the reference pattern and a side edge of the receiving medium may then be determined by determining the distance between the two detected positions. The detection of the positions may be carried out by suitable detection means. The type of detection means suitable may depend on the type of receiving medium used and/or the material used to apply the reference pattern. For example, an optical scanner may be used. Examples of optical scanners are a CCD scanner, a line scanner, a CIS scanner, an active pixel sensor (APS), such as a CMOS APS, a photodiode, for example a photodiode organized in a 2D grid.

Alternatively, when the material used to apply the reference pattern is a magnetic material, then magnetic detection means may be applied. Preferably, one detection means is used to detect both the side edge of the receiving medium and the reference pattern.

The distance between the detection means and the print head may be larger than the distance between the reference pattern and the side edge of the receiving medium. In case the carriage carries more than one print head, then the distance between each print head and the detection means may be larger than the distance between the reference pattern and the side edge of the receiving medium. The carriage and the receiving medium may be moved with respect to each other in the main scanning direction in reciprocation. When moving, the carriage carrying the detection means and the print head may traverse the side edge of the receiving medium. Depending on the position of the detection means and the print head mounted on the carriage with respect to one another and based on the direction of the movement (backward or forward movement in the main scanning direction), the reference pattern may be detected by the detection means before the side edge of the receiving medium is detected, or the side-edge may be detected before the reference pattern is detected. It is preferred that both the reference pattern and the side edge of the receiving medium have been detected by the detection means and thus, that the distance between the reference pattern and the side edge of the receiving medium may be determined before the print head arrives at a position above the reference pattern, where the print head may print the dots in the area between the reference pattern and the side edge of the receiving medium.

If the carriages is moved in the main scanning direction, such that the detection means first detect the side edge of the receiving medium and subsequently detect the reference pattern, the distance between the reference pattern and the side edge of the receiving medium may only be determined after the detection means has detected the reference pattern. Because the absolute distance between the print head and the detection means may not be known exactly, for example, because of thermal expansion of the carriage, the distance between the reference pattern and the side edge of the receiving medium may need to be determined, in order to determine dots to be printed in the area between the side edge of the receiving medium and the reference pattern. Therefore, the distance between the reference pattern and the side edge of the receiving medium may need to be determined before the dots are printed in the area between the side edge of the receiving medium and the reference pattern; i.e.: the distance between the reference pattern and the side edge of the receiving medium may need to be determined before the print head traverses the side edge of the receiving medium. Therefore, the distance between the detection means and each print head may be larger than the distance between the reference pattern and the side edge of the receiving medium.

It may be preferable to provide the carriage with two detection means, wherein the print heads mounted on the carriage are positioned in between the detection means. This may allow the distance between the reference pattern and the side edge to be detected determined before the dots are printed in the area between the side edge of the receiving medium and the reference pattern in both a forward and in a backward scanning direction and may consequently improve accuracy.

However, it is also possible to provide the carriage with only one detection means. This may allow to use a carrier configuration that is simpler and cheaper. Not all distances between reference pattern and the side edge of the receiving medium may be determined, but optionally, the distance between the side edge of the receiving medium and the reference pattern determined in a previous swath may be used to estimate the area were dots are to be printed in the subsequent swath.

In an embodiment, the reference pattern is a line of dots. By applying a reference pattern consisting of a plurality of dots, a plurality of reference points may be applied onto the receiving medium. By applying a plurality of reference points onto the receiving medium, the distance between the reference pattern and the side edge of the receiving medium may be determined based on a plurality of reference points, which may increase the accuracy of the determination of said distance.

In a further embodiment, the reference pattern is applied substantially perpendicular to the main scanning direction. The reference pattern may be applied by the print head mounted on the carriage. The print head may comprise a row of orifices. By firing the orifices of the row of orifices at the same time, a line of dots may be applied on the receiving medium. The reference pattern may be applied substantially perpendicular to the main scanning direction. The main scanning direction may be essentially perpendicular to the sub scanning direction. Thus, the reference pattern that extends in a direction substantially perpendicular to the main scanning direction may extend substantially parallel in the sub scanning direction. Generally, the side edge of the receiving medium may be substantially linear and may extend in a direction substantially perpendicular to the main scanning direction. Thus, by applying the reference pattern substantially perpendicular to the main scanning direction, the pattern may be applied substantially parallel to the side edge of the receiving medium. When the detection means mounted on the carriage moves in the main scanning direction, the distance between the reference pattern and the side edge of the receiving medium may be determined along a part of the side edge of the receiving medium in one swath. The distance between a point of the reference pattern and the side edge may be determined for each point of the reference pattern separately, or the average distance between the reference pattern and the side edge in the main scanning direction may be determined.

In a further embodiment, the reference pattern is a line of yellow dots. Often, the receiving medium is a white medium, for example white paper. Yellow dots may result in a low contrast between the reference pattern and the receiving medium, especially when a white receiving medium is used. Because of the low contrast between yellow and white to the human eye, the reference pattern may be hardly noticed by a viewer looking at the image printed on the receiving medium. Thus, the reference pattern may not or hardly influence the image observed on the receiving medium after it has been printed. Although yellow dots show low contrast on white media to the human eye, detection means, such as a scanner, may still be able to detect the yellow dots forming the reference pattern on the receiving medium. Therefore, using a line of yellow dots, the accuracy of full bleed printing may be improved, without negatively influencing the quality of the image.

In an embodiment, in step c), detection of the position of the reference pattern and detection of the position of the side edge of the receiving medium is performed by detection means mounted on the carriage, and wherein the detection means is a line scanner and wherein the line scanner is positioned essentially perpendicular to the main scanning direction. Use of a line scanner as detection means may enable to scan an area of the receiving medium in one movement of the carriage. When the carriage moves in the main scanning direction and a line scanner is positioned essentially perpendicular to the main scanning direction, an essentially rectangular area of the receiving medium may be scanned in a scanning movement of the carriage. When a line scanner is moved from a position above the reference pattern to a position above the side edge of the receiving medium, the distance between the reference pattern and the side edge of the receiving medium in the direction of the main scanning direction may be determined along a part of the side edge of the receiving medium.

In an embodiment, the line scanner may have a width at least equal to the length of the reference pattern, measured in a direction substantially perpendicular to the main scanning direction. In that case, the line scanner may detect the whole reference pattern when reciprocating in the main scanning direction.

In an embodiment, the carriage is provided with two line scanners, wherein each print head is positioned in between a first one of the two line scanners and a second one of the two line scanners with respect to the main scanning direction. The carriage, being provided with two line scanners and at least one print head, may be moved in reciprocation in the main scanning direction. Thus, the carriage may be moved in a backward and forward main scanning direction. In order to print full bleed, the dots to be printed have to be determined. In the present invention, dots to be printed in an area between the side edge of the receiving medium and the reference pattern may be determined based on the distance between the reference pattern and the side edge of the receiving medium, which distance may be determined based on the detected position of the reference pattern and the detected position of the side edge of the receiving medium. Therefore, it is preferred to determine said distance before the print head is moved over the area between the side edge of the receiving medium and the reference pattern to print dots in said area. When the carriage is provided with two line scanners and wherein the at least one print head mounted on the carriage is positioned in between the two line scanners, then the distance between the reference pattern and the side edge may be determined before the print head moves over the area in between the reference pattern and the side edge, both in the backward main scanning direction and in the forward main scanning direction.

In an embodiment, the inkjet printing apparatus further comprises a linear position encoding system, wherein the receiving medium comprises a first side edge and a second side edge, wherein dots to be printed in between the first side edge and the second side edge are determined based on a determined distance between the reference pattern and the first side edge and on a determined position of the second side edge of the receiving medium, and wherein the position of the first side edge and the second side edge are correlated to corresponding positions on the linear position encoding system and wherein the distance between the reference pattern and the second side edge is correlated to a corresponding distance on the linear position encoding system.

When the position of a reference pattern and the position of a side edge of the receiving medium in proximity of the reference pattern are detected, the distance between the reference pattern and the side edge may be determined. In a printing apparatus comprising a linear position encoding system, the detected positions may be correlated to corresponding positions on the linear position encoding system. Consequently, the determined distance between the reference pattern and the side edge may be correlated to a corresponding distance on the linear position encoding system. By correlating the distance between the reference pattern and the side edge of the receiving medium to a corresponding distance on the linear position encoding system, the linear position encoding system may be calibrated. This may compensate for errors in the linear position encoding system, e.g. errors caused by thermal expansion.

When reciprocating in the main scanning direction, the carriage may also detect the position of the second side edge of the receiving medium. The position of the second side edge may be correlated to a corresponding position on the linear position encoding system. Because the linear position encoding system was calibrated, the distance between the first and second side edge of the receiving medium may be determined based on the corresponding positions on the linear position encoding system. An advantage of this embodiment is that a reference pattern has to be applied on only one side edge of the receiving medium.

In an embodiment, in step d, the number of dots and/or a distance between dots to be printed is determined based on the determined distance between the reference pattern and the side edge of the receiving medium.

An image may be applied onto the receiving medium by applying a predetermined pattern of ink droplets onto the receiving medium. When printing full bleed, the image may be adapted to fill the area between the first and second side edge of the receiving medium. As a result, the pattern of ink droplets may have to be adapted in order for the image to fit the image in between the and second side edge of the receiving medium. The pattern of ink droplets may be adapted by changing the number of droplets to be printed. For example, if the image is larger than the area of the receiving medium onto which the image is to be applied, droplets, e.g. droplets positioned at the periphery of the image may not be printed. Alternatively, if the image is smaller than the area of the receiving medium onto which the image is to be applied, additional droplets may be printed between the border of the image and a side edge of the receiving medium. Instead of changing the number of droplets to be printed, or in addition thereto, the distance between the droplets may be adapted. In case the image is smaller than the area of the receiving medium onto which the image is to be applied, the distance between the droplets applied onto the receiving medium may be enlarged. In case the image is larger than the area of the receiving medium onto which the image is to be applied, the distance between the droplets applied onto the receiving medium may be reduced.

The pattern of ink droplets may be adapted by changing the number of droplets to be printed in the area between the side edge of the receiving medium and the reference pattern only or, alternatively, the pattern of ink droplets may be adapted by changing the number of droplets to be printed in the area between both side edge of the receiving medium.

In an aspect of the invention, an inkjet printing apparatus configured to in operation carry out the method according to the present invention, is provided, the inkjet printing apparatus comprising a carriage, said carriage comprising a print head a detection means for detecting the reference pattern and the side edge of the receiving medium. The carriage of the inkjet printing apparatus may comprise at least one print head, the at least one print head comprising at least one orifice for ejecting droplets of a fluid, e.g. ink. The carriage may be arranged to be movable with respect to the receiving medium in a main scanning direction and a sub scanning direction. The carriage may further comprise detection means for detecting the reference pattern and for detecting the side edge of the receiving medium. The detection means may comprise e.g. a scanner.

DETAILED DESCRIPTION OF THE DRAWINGS

Figure 1A:
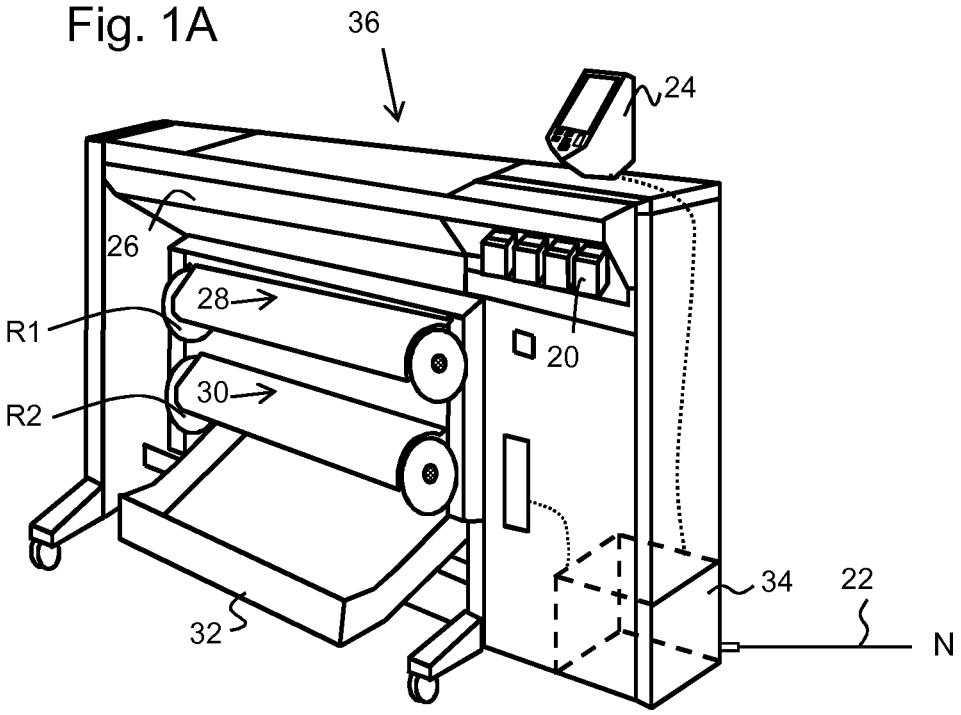
FIG. 1A shows a schematic representation of an image forming apparatus.

In the drawings, same reference numerals refer to same elements.

Figure 1B:
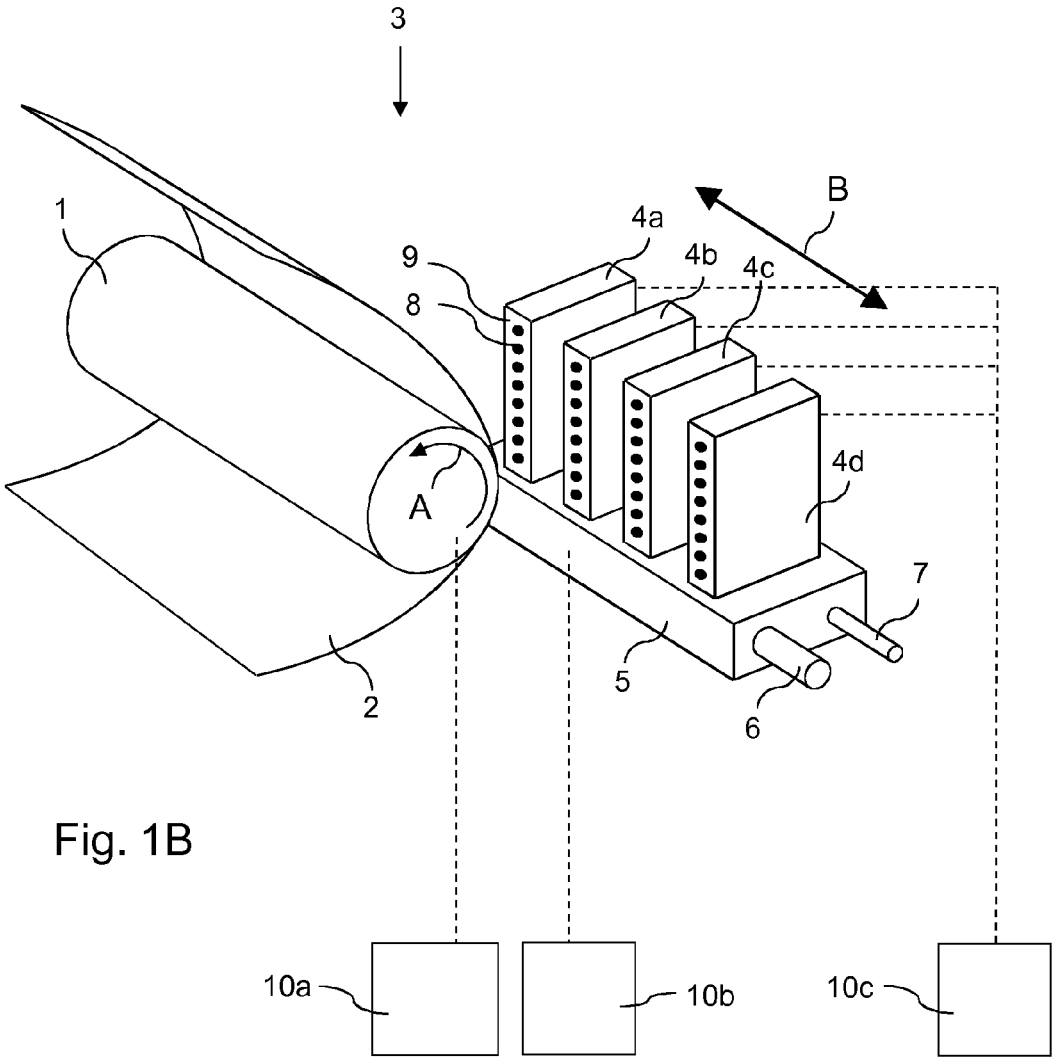
FIG. 1B shows a schematic representation of an ink jet printing assembly.

FIG. 1A shows an image forming apparatus 36, wherein printing is achieved using a wide format inkjet printer. The wide-format image forming apparatus 36 comprises a housing 26, wherein the printing assembly, for example the ink jet printing assembly shown in FIG. 1B is placed. The image forming apparatus 36 also comprises a storage means for storing image receiving member 28, 30, a delivery station to collect the image receiving member 28, 30 after printing and storage means for marking material 20. In FIG. 1A, the delivery station is embodied as a delivery tray 32. Optionally, the delivery station may comprise processing means for processing the image receiving member 28, 30 after printing, e.g. a folder or a puncher. The wide-format image forming apparatus 36 furthermore comprises means for receiving print jobs and optionally means for manipulating print jobs. These means may include a user interface unit 24 and/or a control unit 34, for example a computer.

Images are printed on a image receiving member, for example paper, supplied by a roll 28, 30. The roll 28 is supported on the roll support R1, while the roll 30 is supported on the roll support R2. Alternatively, cut sheet image receiving members may be used instead of rolls 28, 30 of image receiving member. Printed sheets of the image receiving member, cut off from the roll 28, 30, are deposited in the delivery tray 32.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 34 placed inside the printing apparatus 36. The control unit 34, for example a computer, comprises a processor adapted to issue commands to the print engine, for example for controlling the print process. The image forming apparatus 36 may optionally be connected to a network N. The connection to the network N is diagrammatically shown in the form of a cable 22, but nevertheless, the connection could be wireless. The image forming apparatus 36 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow A. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the image receiving member 2 in the main scanning direction B. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow, is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material. In addition, the carriage 5 may carry one or more detection means (not shown) for detecting the side edge of the receiving medium and for detecting the reference pattern.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction B.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction A. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9, may negatively influence the ejection of droplets and the placement of these droplets on the image receiving member 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 2A:
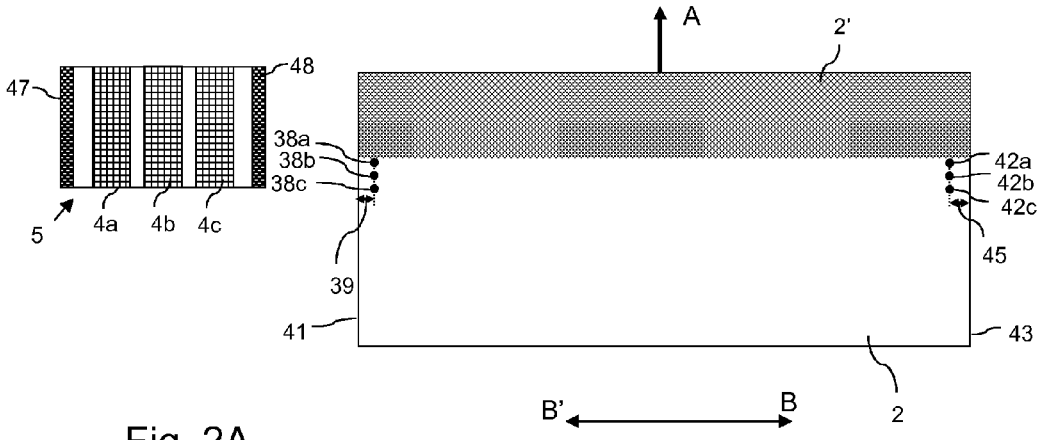
FIG. 2A-2C illustrate a first embodiment of a method for full bleed printing according to the present invention.

FIG. 2A shows a top view of a receiving medium 2 and a carriage 5, the carriage 5 carrying a first and a second line scanner 47, 48 and a number of print heads. Three print heads 4*a*-4*c* are depicted in FIG. 2A, but in practice any number of print heads may be mounted on the carriage. Each of the print heads 4*a*-4*c* is positioned in between the first scanner 47 and the second scanner 48. The first line scanner 47 and the second line scanner 48 are positioned substantially perpendicular to the main scanning direction B, B'. The carriage 5 is adapted to move in reciprocation in forward, resp. backward main scanning direction B, B'.

A part of the receiving medium 2 is a part provided with an image 2'. The image 2' is applied on the receiving medium by the print head 4*a*-4*c*, mounted on the carriage.

The receiving medium has a first side edge 41 and a second side edge 43. When the carriage 5 moves in the forward scanning direction B, the carriage moves in a direction from the first side edge 41 to the second side edge 43. When the carriage 5 moves in the backward scanning direction B', the carriage moves in a direction from the second side edge 43 to the first side edge 41.

The carriage 5 is positioned above a position outside the side edges 41, 43 of the receiving medium 2, as is shown in FIG. 2A. The carriage 5 has moved over the receiving medium in a current swatch in the main scanning direction B'. In the current swath, reference patterns were printed. In proximity to the first side edge 41, a reference pattern consisting of three dots 38*a*, 38*b*, 38*c*, was printed. The dots 38*a*, 38*b*, 38*c* forming the reference pattern are printed in a straight line. The distance between dots 38*a* and 38*b* is essentially the same as the distance between dots 38*b* and 38*c*. The reference pattern 38 is applied to the receiving medium 2 at a distance 39 from the first side edge 41 of the receiving medium.

In proximity of the second side edge 43, a reference pattern consisting of three dots 42*a*, 42*b*, 42*c*, was printed. The dots 42*a*, 42*b*, 42*c* forming the reference pattern are printed in a straight line. The reference pattern 42 is applied to the receiving medium 2 at a distance 45 from the second side edge 43. As shown in FIG. 2A, the carriage 5 has traversed the receiving medium 2 in a current swath, and has printed the image 2' onto the receiving medium 2 in the current swath.

Figure 2B:
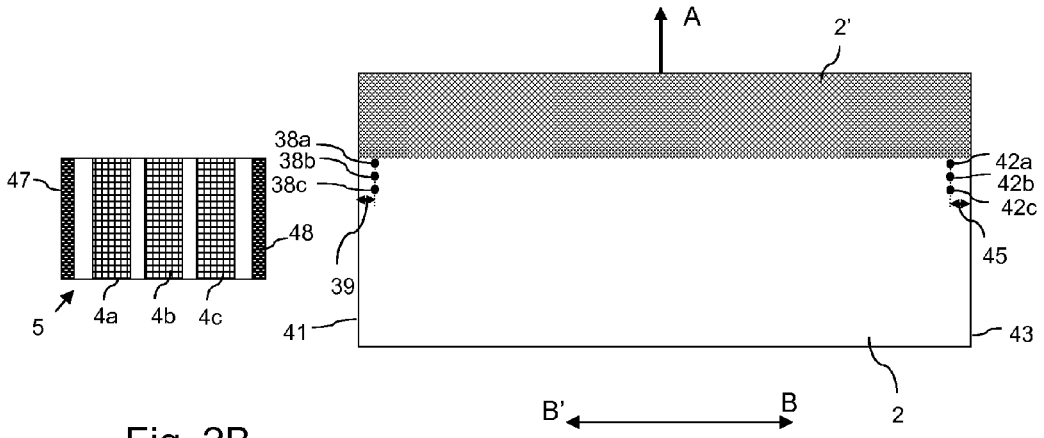

FIG. 2B shows a top view of a receiving medium 2 and the carriage 5, the carriage 5 carrying a first and a second line scanner 47, 48 and a number of print heads 4*a*-4*c*. Compared to FIG. 2A, the receiving medium 2 and the carriage 5 have moved with respect to each other in the sub scanning direction A. The receiving medium 2 and the carriage 5 are now positioned with respect to each other such that, upon relative movement of the carriage 5 and the receiving medium 2 with respect to one another in the main scanning direction B, a next swath may be printed, and the reference patterns 38, 40, applied in the current swath, may be detected by at least one of the scanners 47, 48, mounted on the carriage 5.

Figure 2C:
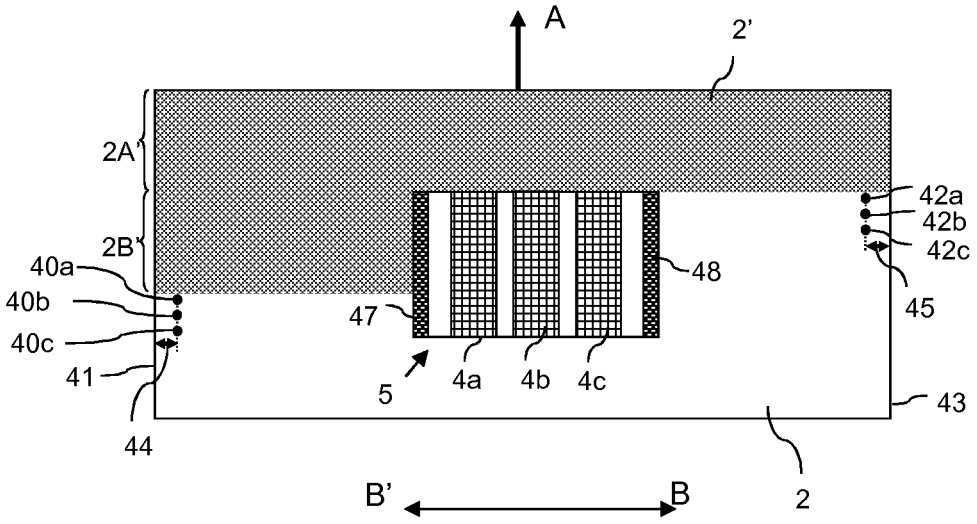

FIG. 2C shows a top view of a receiving medium 2 and the carriage 5, the carriage 5 carrying a first and a second line scanner 47, 48 and print heads 4*a*-4*c*. In FIG. 2C, the carriage 5 moves in the forward main scanning direction B. Compared to the situation depicted in FIG. 2B, the carriage 5 has moved in the forward main scanning direction B. The carriage 5 has passed the first side edge 41 of the receiving medium 2. As a consequence, the second scanner 48 has passed the first side edge 41 as well as the reference pattern 38 (not shown), and has detected the first side edge 41 and the reference pattern 38 (not shown). Based on the detected positions, dots to be printed in the area between the reference pattern 38 and the first side edge 41 may be determined. Moreover, a reference pattern 40 is applied in proximity of the first side edge 41. The reference pattern 40 may be used to determine dots to be printed in the area in between the reference pattern 40 and the first side edge 41 in a later swath.

In proximity to the second side edge 43, the reference pattern 42 is applied, consisting of dots 42*a*-42*c*, which are applied onto the receiving medium 2 in a straight line. As shown in FIG. 2C, the carriage 5 is advancing in the forward main scanning direction B. Upon further advancing in the forward main scanning direction B, the second scanner 48 arrives at a position where it detects the dots 42*a*-42*c*, forming the reference pattern 42 and afterwards it detects the second side edge 43. Based on these detected positions, the distance 45 between the second side edge 43 and the reference pattern 42 may be determined, based on which dots to be printed in the area between the second side edge 43 and the reference pattern 42 are determined.

Figure 3:
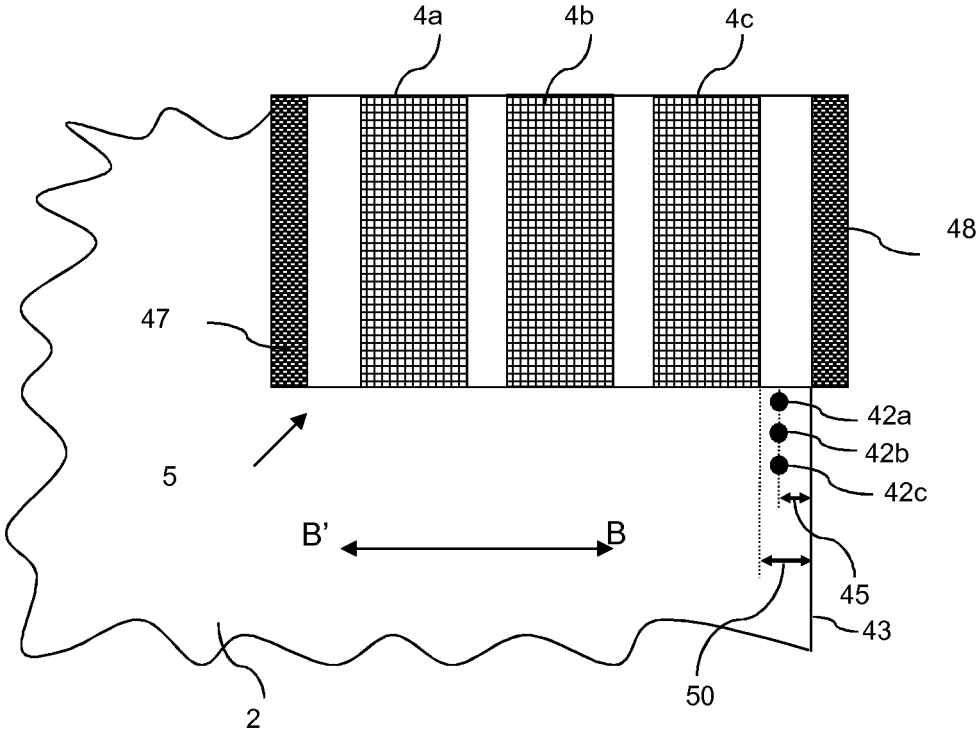
FIG. 3 illustrates a second embodiment of a method for full bleed printing according to the present invention.

FIG. 3 shows a top view of a fragment of the receiving medium 2 and the carriage 5, the carriage 5 moving over the receiving medium 2 in the main scanning direction B, B'. The carriages 5 carries a first line scanner 47, a second line scanner 48 and three print heads 4*a*-4*c*. Each print head 4*a*-4*c* is positioned in between the first line scanner 47 and the second line scanner 48. The print head 4*c* is the print head which is mounted on the carriage in a position closer to the second line scanner 48 than each of the other print heads 4*a*, 4*b*. The distance 50 between the second scanner 48 and the print head 4*c* is larger than the distance 45 between the second side edge 43 and the reference pattern 42. Thus, when the carriage 5 advances in the forward scanning direction B, the second scanner 48 moves to a position above the second side edge 43, before any of the print heads 4*a*-4*c* has moved in a position above the reference pattern 42. As a consequence, the distance 45 between the second side edge 43 and the reference pattern 42 may be determined, and dots to be printed in the area between the second side edge 43 and the reference pattern 42 may be determined, before any of the print heads 4*a*-4*c* is positioned above the area in between the second side edge 43 and the reference pattern 42 and print the determined dots to form an image on the receiving medium 2. Moreover, when the carriage 5 moves in the forward main scanning direction B over the first side edge 41 (not shown), the second scanner 48 moves over the first side edge 41 and a corresponding reference pattern—and thus may determine the distance between the first side edge 41 and the reference pattern—before any of the print heads 4*a*-4*c* moves over the first side edge 41.

Figure 4:
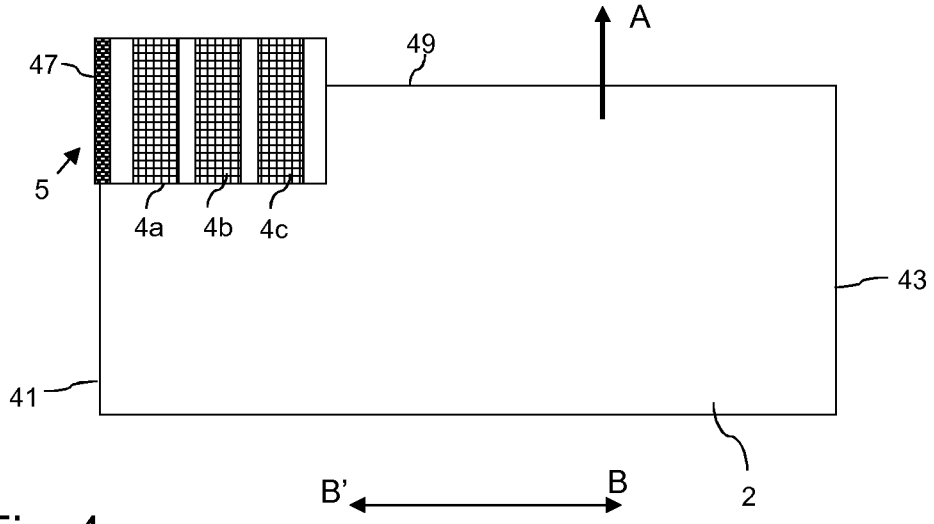
FIG. 4 illustrates a third embodiment of a method for full bleed printing according to the present invention.

FIG. 4 shows a top view of the receiving member 2 and the carriage 5. The carriage 5 carries a scanner 47 and a plurality of print heads 4*a*-4*c*. The carriage 5 moves in the main scanning direction B,B' and moves over a leading edge 49 of the receiving medium 2 in a first swath. The leading edge 49 of the receiving medium 2 may be the leading edge of a sheet of cut sheet paper, or may e.g. be the leading edge of a roll of paper. The carriage 5, as shown in FIG. 4 is positioned such that the scanner 47 is positioned above the first side edge of the receiving member. The scanner is now able to detect the first side edge 41 of the receiving medium 2. The print heads do not yet apply an image to the receiving member 2. Based on the detected position of the first side edge 41 of the receiving medium, the position of the reference pattern to be applied may be determined and the reference pattern may be applied onto the receiving medium 2.

Figure 5A:
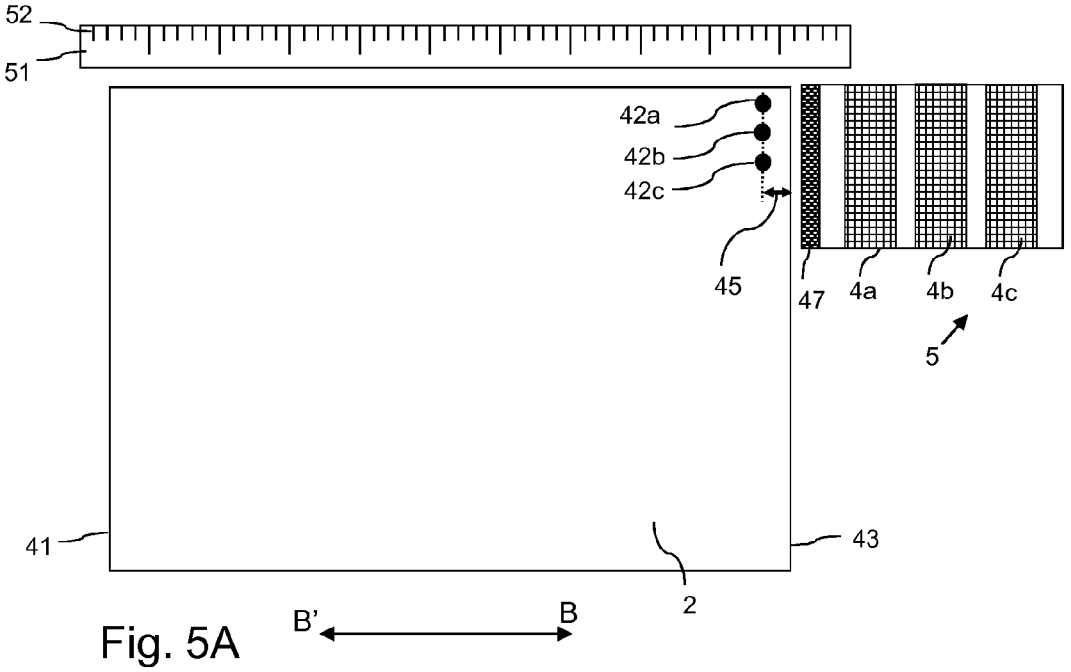
FIG. 5A-5B illustrate a fourth embodiment of a method for full bleed printing according to the present invention.

FIG. 5A shows a top view of a fragment of the receiving medium 2 and the carriage 5, the carriage 5 moving over the receiving medium 2 in the backward main scanning direction B'. The printing apparatus (not shown) comprises a linear position encoding system 51. This linear position encoding system 51 comprises marks 52. By monitoring the number of marks 52 the carriage 5 passes after the beginning of a swath, the position of the carriage 5 may be monitored. The number of marks 52 passed by the carriage may be monitored by a monitoring means (not shown), such as a sensor, mounted on the carriage 5.

When moving in the backward main scanning direction B', the carriage moves from the second side edge 43 to the first side edge 41. As depicted in FIG. 5A, the carriage 5 is in the beginning of the swath. The carriage 5 moves over the second side edge 43 and subsequently over the reference pattern 42, formed by the dots 42*a*-42*c*. The reference pattern 42, as well as the second side edge 43 of the receiving medium 2 are detected by the scanner 47 mounted on the carriage, and thereby, the distance 45 between the reference pattern 42 and the second side edge 43 of the receiving medium 2 may be detected. The distance 45 between the reference pattern 42 and the second side edge 43 of the receiving medium 2 may be correlated to a number of marks 52 on the linear encoding system 51. Thus, the distance of a predetermined part of the receiving medium 2 is correlated to a number of marks 52 on the linear position encoding system 51. By correlating a distance on the receiving medium 2 to a number of marks 52, errors in the position determined by the linear position encoding system 51, e.g. errors introduces because of differences in thermal expansion between the linear position encoding system 51 and other parts of the inkjet printing machine, may be corrected for.

Figure 5B:
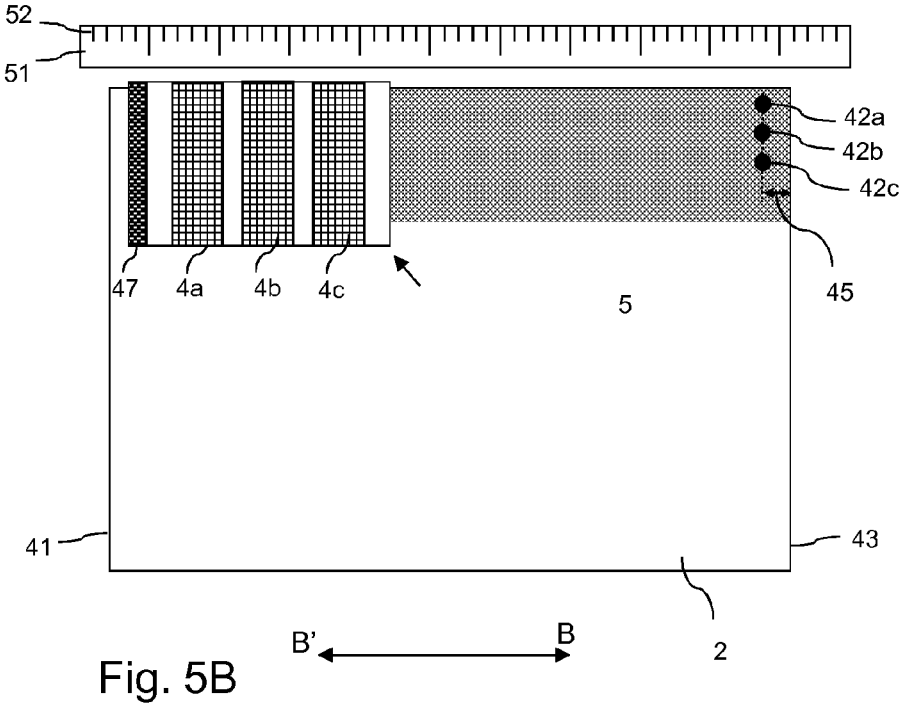

In FIG. 5B, the carriage 5 has proceeded in the backward main scanning direction B', with regard to the situation depicted in FIG. 5A. The carriage 5 is now nearly in the position where the scanner 47 is able to detect the position of the first side edge 41. The position of the first side edge 41 may be correlated to a position on the linear position encoding system 51. Because the distance between the reference pattern 42 and the second side edge 43 of the receiving medium 2 was correlated to a distance on the linear position encoding system 51 and in addition, the position was of the first side edge 41 of the receiving medium 2 was correlated to a corresponding position on the linear position encoding system 51, the distance between the first side edge 41 and the second side edge 43 may be determined based on the corresponding positions on the linear encoding system 51. Based on the distance between the first and second side edge 41, 43, dots to be printed in between the first side edge 41 and the second side edge 43 may be determined.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

The invention claimed is:

1. A method for full bleed printing using an inkjet printing apparatus, the inkjet printing apparatus comprising a carriage, the carriage comprising a print head, the method comprising:

a) in a current swath, moving the carriage and a receiving medium relative to each other in a main scanning direction and printing a reference pattern on the receiving medium;

b) moving the carriage and the receiving medium relative to each other in a sub-scanning direction;

c) in a subsequent swath, determining a distance between the reference pattern and a side edge of the receiving medium;

d) based on the determined distance between the reference pattern and the side edge of the receiving medium, determining dots to be printed in an area between the side edge of the receiving medium and the reference pattern.

2. The method according to claim 1, wherein the method further comprises:

i. in a first swath, moving the carriage and the receiving medium relative to each other in a main scanning direction;

ii. detecting a position of a side edge of the receiving medium;

iii. determining, based on the position of the side edge of the receiving medium, the position of the reference pattern to be printed;

wherein steps i-iii are carried out before step a.

3. The method according to claim 2, wherein in step c), the distance between the reference pattern and a side edge of the receiving medium is determined based on a detected position of the reference pattern and on a detected position of the side edge of the receiving medium and wherein detection of the position of the reference pattern and detection of the position of the side edge of the receiving medium is performed by detection means mounted on the carriage, and wherein the distance between the detection means and each print head is larger than the distance between the reference pattern and the side edge of the receiving medium.

4. The method according to claim 2, wherein the reference pattern is a line of dots.

5. The method according to claim 1, wherein in step c), the distance between the reference pattern and a side edge of the receiving medium is determined based on a detected position of the reference pattern and on a detected position of the side edge of the receiving medium and wherein detection of the position of the reference pattern and detection of the position of the side edge of the receiving medium is performed by detection means mounted on the carriage, and wherein the distance between the detection means and each print head is larger than the distance between the reference pattern and the side edge of the receiving medium.

6. The method according to claim 5, wherein in step c), detection of the position of the reference pattern and detection of the position of the side edge of the receiving medium is performed by detection means mounted on the carriage, and wherein the detection means is a line scanner and wherein the line scanner is positioned essentially perpendicular to the main scanning direction.

7. The method according to claim 6, wherein the carriage is provided with two line scanners, wherein each print head is positioned in between a first one of the two line scanners and a second one of the two line scanners with respect to the main scanning direction.

8. The method according to claim 1, wherein the reference pattern is a line of dots.

9. The method according to claim 8, wherein the reference pattern is applied substantially perpendicular to the main scanning direction.

10. The method according to claim 9, wherein the reference pattern is a line of yellow dots.

11. The method according to claim 8, wherein the reference pattern is a line of yellow dots.

12. The method according to claim 1, wherein the inkjet printing apparatus further comprises a linear position encoding system, wherein the receiving medium comprises a first side edge and a second side edge, wherein dots to be printed in between the first side edge and the second side edge are determined based on a determined distance between the reference pattern and the first side edge and on a determined position of the second side edge of the receiving medium, and wherein the position of the first side edge and the second side edge are correlated to corresponding positions on the linear position encoding system and wherein the distance between the reference pattern and the second side edge is correlated to a corresponding distance on the linear position encoding system.

13. The method according to claim 1, wherein in step d, the number of dots and/or a distance between dots to be printed is determined based on the determined distance between the reference pattern and the side edge of the receiving medium.

14. An inkjet printing apparatus comprising a carriage, said carriage comprising a print head and a detection means for detecting the reference pattern and the side edge of the receiving medium, the inkjet printing apparatus being configured to:

a) in a current swath, move the carriage and a receiving medium relative to each other in a main scanning direction and print a reference pattern on the receiving medium;

b) move the carriage and the receiving medium relative to each other in a sub-scanning direction;

c) in a subsequent swath, determine a distance between the reference pattern and a side edge of the receiving medium; and d) based on the determined distance between the reference pattern and the side edge of the receiving medium, determine dots to be printed in an area between the side edge of the receiving medium and the reference pattern.

15. The inkjet printing apparatus according to claim 14, the inkjet printing apparatus being configured to:

i. in the first swath, move the carriage and the receiving medium relative to each other in a main scanning direction;

ii. detect a position of a side edge of the receiving medium;

iii. determine, based on the position of the side edge of the receiving medium, the position of the reference pattern to be printed;

wherein i-iii are carried out before move the carriage and a receiving medium relative to each other in a main scanning direction and print a reference pattern on the receiving medium.

16. The inkjet printing apparatus according to claim 14, the inkjet printing apparatus being configured to such that, in the subsequent swath, the distance between the reference pattern and a side edge of the receiving medium is determined based on a detected position of the reference pattern and on a detected position of the side edge of the receiving medium and wherein detection of the position of the reference pattern and detection of the position of the side edge of the receiving medium is performed by the detection means mounted on the carriage, and wherein the distance between the detection means and each print head is larger than the distance between the reference pattern and the side edge of the receiving medium.

17. The inkjet printing apparatus according to claim 16, wherein the detection means is a line scanner, and wherein the line scanner is positioned essentially perpendicular to the main scanning direction.

18. The inkjet printing apparatus according to claim 14, wherein the reference pattern is a line of dots.

19. The inkjet printing apparatus according to claim 18, wherein the reference pattern is applied substantially perpendicular to the main scanning direction.

20. The inkjet printing apparatus according to claim 18, wherein the reference pattern is a line of yellow dots.

* * * * *